US007413454B2

(12) United States Patent
Reber et al.

(10) Patent No.: US 7,413,454 B2
(45) Date of Patent: Aug. 19, 2008

(54) APPARATUS FOR SIGNAL TRANSMISSION BETWEEN TERMINALS

(75) Inventors: Wolfgang Reber, Tirschenreuth (DE); Helmut Rebhan, Weiden (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 11/545,805

(22) Filed: Oct. 10, 2006

(65) Prior Publication Data

US 2007/0149019 A1 Jun. 28, 2007

(30) Foreign Application Priority Data

Dec. 19, 2005 (EP) ..... 05292738

(51) Int. Cl.
*H01R 3/00* (2006.01)

(52) U.S. Cl. ..... 439/164

(58) Field of Classification Search ..... 439/164, 439/15

See application file for complete search history.

(56) References Cited

U.S. PATENT DOCUMENTS 5,137,463 A 8/1992 Sasaki et al. ..... 439/164
5,171,153 A * 12/1992 Kubota et al. ..... 439/15
5,643,002 A * 7/1997 Wolf et al. ..... 439/164
2001/0012713 A1 8/2001 Rebhan et al. ..... 439/164

* cited by examiner

*Primary Examiner*—Neil Abrams
(74) *Attorney, Agent, or Firm*—Sofer & Haroun, LLP

(57) ABSTRACT

An apparatus for signal transmission between terminals (6, 8), between which at least one cable (10) is arranged, which is accommodated in an essentially circular cassette (K), to which ongoing cables can be connected at the terminals, and whose length is greater than the distance between the terminals. The cassette (K) comprises a rotor (R), which can rotate about its axis and bears at least one terminal, and a stationary stator (S), which likewise bears at least one terminal. The rotor (R) has a cylindrical hub (17), which runs in the axial direction of the cassette (K) and on which means are provided for fitting an intermediate base (16), which runs parallel to the cover face (18) and the base (19) of the accommodating area (15), is arranged at a distance from them, and divides the accommodating area (15) in a variable manner according to the height or width of the cable (10) to be inserted into the cassette into a smaller area (V) for the cable (10) and an empty area (L).

2 Claims, 3 Drawing Sheets

APPARATUS FOR SIGNAL TRANSMISSION BETWEEN TERMINALS

RELATED APPLICATION

This application is related to and claims the benefit of priority from European Patent Application No. 05292738.1, filed on Dec. 19, 2005, the entirety of which is incorporated herein by reference.

1. Field of the Invention

The invention relates to an apparatus for signal transmission between terminals, between which at least one cable is arranged.

2. Background

Apparatuses exist for signal transmission between terminals, between which at least one cable is arranged, which is accommodated in an essentially circular cassette, to which ongoing cables can be connected at the terminals, and whose length is greater than the distance between the terminals, in the case of which the cassette comprises a rotor, which can rotate about its axis and bears at least one terminal, and a stationary stator, which likewise bears at least one terminal, which rotor and stator delimit a circular accommodating area having a rectangular cross section, which serves the purpose of accommodating the cable, has a cover face and a base, running parallel thereto, and whose clear axial height can be changed in a variable manner by means of at least one insert part (DE 199 60 205 A1).

Such an apparatus is used, for example, for transmitting signals and electrical current for the purpose of triggering the "airbag" of an impact protection system for motor vehicles and for other functions, but also for sliding-door wiring or steering-gear wiring of motor vehicles. One problem to be solved by such an apparatus is the transmission of signals and current between stationary and moving parts of the motor vehicle. The sliding contacts or sliprings which have long been known for such cases are subject to wear and are disadvantageous in particular in the case of low current levels owing to the fluctuating contact resistance.

U.S. Pat. No. 5,643,002 describes a cassette comprising a rotor and a stator with an enclosed cable for the purpose of connecting two terminals using the so-called reversing technique. The cable is split into two subwindings with different winding senses, which subwindings merge with one another at a reversal point. An annular guide body is arranged between the subwindings and follows the movements of the subwindings in the circumferential direction of the cassette. For a movement which is as smooth-running as possible, the guide body has a collar, which engages into the rotor or its hub and, as a result, can be carried along by the rotor.

In the case of the known apparatus from EP 0 417 350 A1, electrical current is used for the signal transmission. The signal transmission takes place by means of a flat ribbon cable (referred to below as "FRC", for short), which is wound to form a wound body, for example in the manner of a spring barrel. In the case of a relative rotor movement of two terminals connected by the FRC, the wound-on FRC "breathes" like the spring of a clock. The turns of the wound FRC are pulled together in one rotary direction to a smaller diameter. In the other rotary direction, they expand to a larger diameter again.

Two or more conductors spaced apart from one another are arranged in the FRC fitted in the cassette of such apparatuses. The width of the FRC therefore increases as the number of conductors increases if the electrical properties, in particular the nonreactive resistance, are intended to remain unchanged given the same length of the FRC. Since the cable is fitted upright in the accommodating area of the cassette, the word "height" is used instead of the word "width", "height" being intended to mean the axial height of the cable in the accommodating area of the cassette when it has been fitted. The dimensions of the cassette in accordance with EP 0 417 350 A1 already mentioned are selected for the use of a cable with a fixed number of conductors. If a different number of conductors is required than is available in the provided cable, either the dimensions of the cassette need to be matched to a corresponding lower or higher cable or only some of the conductors available in an appropriate cable are used. Both variants are complex.

The apparatus in accordance with DE 199 60 205 A1 mentioned at the outset can be used within wide limits for FRCs with any desired number of conductors. This is achieved by the fact that a compensation body with a variable axial height is fitted to at least one of the faces of the rotor and the stator which delimit the accommodating area, the cover face and the base. Given a constant axial height of the accommodating area of the cassette and a variable axial height of the FRC, the axial height of the compensation body is dimensioned such that the area remaining free between the FRC and the rotor or the stator of the cassette in the axial direction is essentially filled by the compensation body. As a result, one cassette having constant dimensions—in particular of the accommodating area for the FRC—can be used for many different requirements. The number of conductors of the FRC which is respectively to be used can therefore advantageously be matched to the respective application case. FRCs with different heights can therefore be used. The therefore variable axial free area within the accommodating area of the cassette is filled by a compensation body with an appropriate height for each application case. In all cases, the sum of the axial heights of the FRC and the compensation body remains essentially constant. This known apparatus has proven to be successful in practice.

OBJECTS AND SUMMARY

The invention is based on the object of specifying an apparatus which provides an advantageous and extended alternative to the apparatus described at the outset.

This object is achieved according to the invention by the fact that the rotor has a cylindrical hub, which runs in the axial direction of the cassette and on which means are provided for fitting an intermediate base, which runs parallel to the cover face and the base of the accommodating area, is arranged at a distance from them, extends at least essentially over the radial width of the accommodating area and divides the accommodating area in a variable manner according to the height or width of the cable to be inserted into the cassette into a smaller area for the cable and an empty area.

With this apparatus, the axial height of the accommodating area for the FRC can be adjusted in a very simple manner by fitting the intermediate base. According to the height or width of the FRC to be inserted in a cassette, the intermediate base is fixed to the hub of the rotor such that an accommodating area corresponding to this height results. The intermediate base can likewise be coated with a noise-muffling material, as is the case with the stator or rotor delimiting the accommodating area.

In one preferred embodiment, the hub is split transversely into two parts, whose respective length is variable depending on the height or width of the FRC. Both parts in each case supplement one another to form a hub having a constant length. At least one of the parts has an outwardly open, circumferential cutout in the region of its end face, which cutout is used for accommodating and holding the intermediate base.

The intermediate base can extend over the entire radial width of the accommodating area. In the case of a cassette using the so-called "reversing technique", however, it is also possible for a circumferential gap to remain between an outer wall of the cassette and the intermediate base and to then be used as the mount for elements of a guide body for the cable which has been divided into subwindings.

BRIEF DESCRIPTIONS OF THE DRAWINGS

Exemplary embodiments of the subject matter of the invention are illustrated in the drawings, in which.

DETAILED DESCRIPTION

Figure 1:
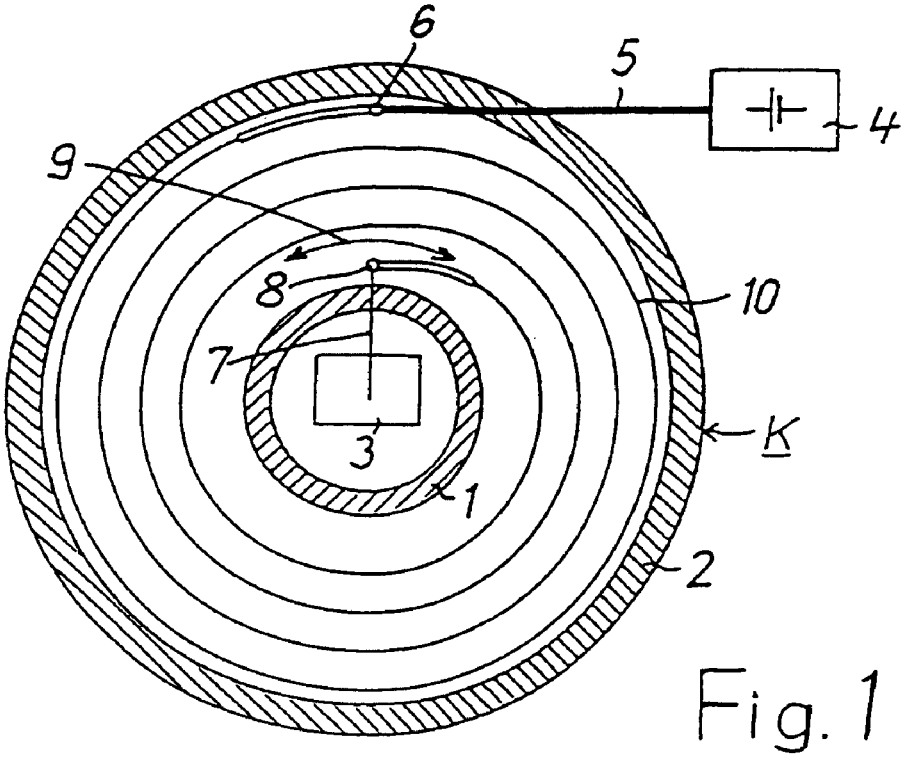
FIG. 1 shows a view of a cassette with an apparatus according to the invention, in a schematic illustration.
Figure 3:
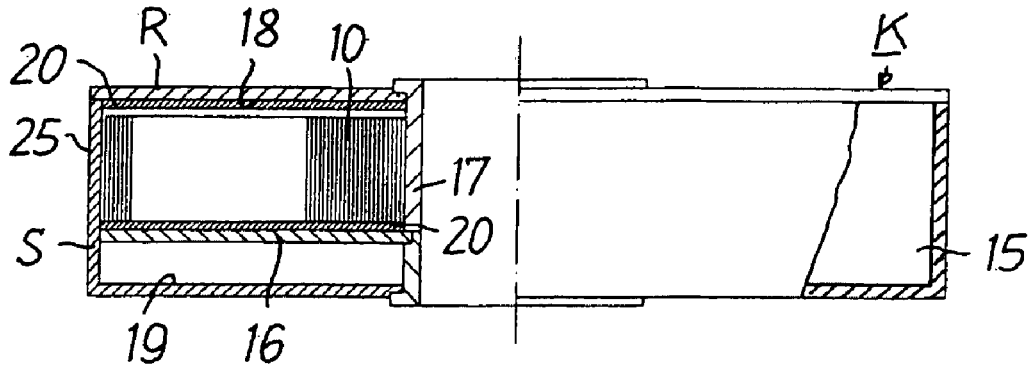
FIGS. 3 and 4 show two cassettes with different embodiments, partially in section.
Figure 4:
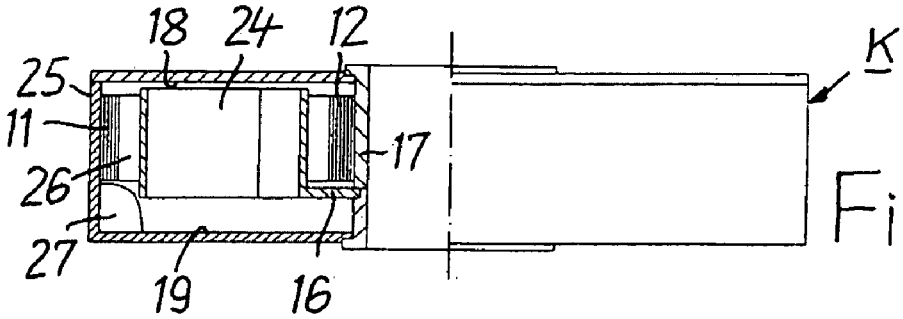
Figure 5:
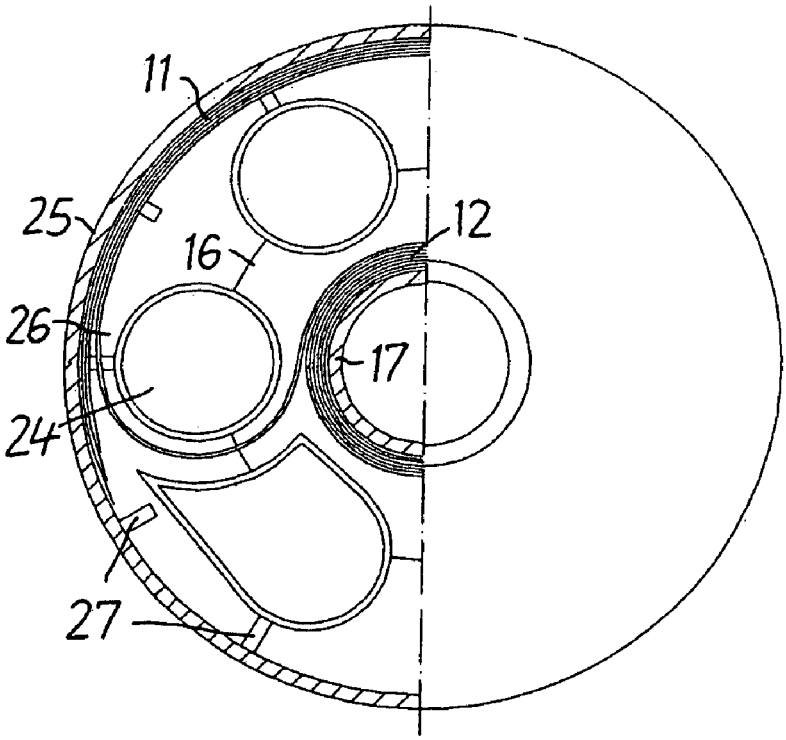
FIG. 5 shows a plan view of FIG. 4.
Figure 6:
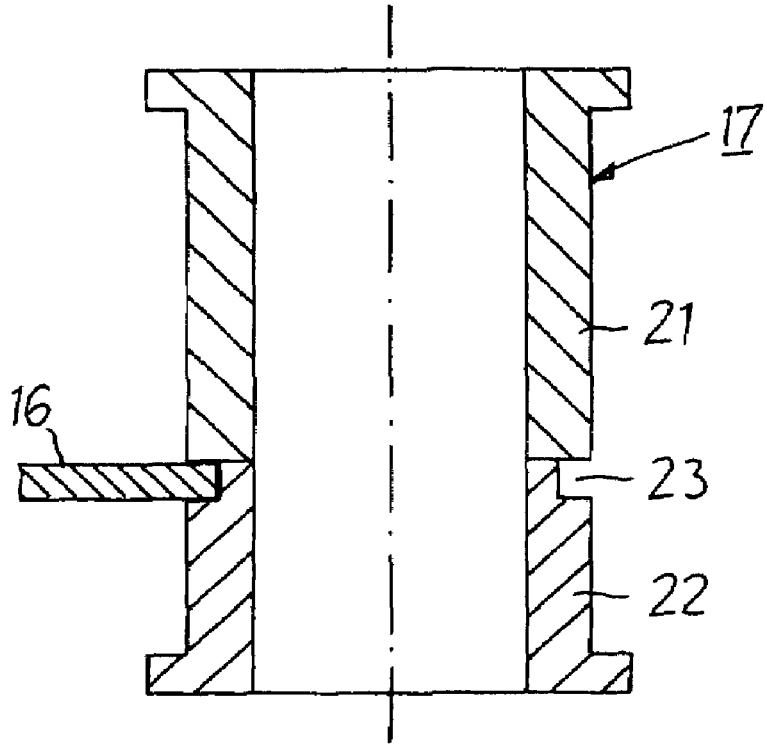
FIGS. 6 and 7 show a detail of the cassettes, in an enlarged illustration with two views.

FIG. 1 schematically illustrates two for example circular walls 1 and 2 of a cassette K. The wall 1 is intended to belong, for example, to the rotor R, and the wall 2 is intended to belong to the stator 3 of the cassette K (FIGS. 3 to 5). It is intended to be installed in the steering wheel of a motor vehicle. In order to supply power to electronics 3, whose signal can be used to trigger an airbag, the cassette K is connected to the battery 4 of the motor vehicle. The battery 4 is connected to a terminal 6, in the form of a fixed point, of the cassette K via an electrical cable 5. The electronics 3 are connected to a terminal 8 of the cassette K via an electrical cable 7, which terminal 8 can be moved in the direction of the double arrow 9. In principle, the terminal 8 could also be fixed and the terminal 6 movable.

An FRC 10 having at least two electrical conductors is fitted between the two terminals 6 and 8. The conductors are preferably in the form of flat conductors. This embodiment of the FRC 10 is particularly thin and therefore takes up very little space. In principle, the FRC 10 could also have round conductors, however. The design of the FRC 10 and the nature of its connection or termination at the terminals 6 and 8 are not illustrated in any more detail. In principle, they are known in various embodiments and are insignificant here.

The FRC 10, as shown in FIG. 1, can be arranged in the cassette K between the two terminals 6 and 8 with a plurality of turns, i.e. in the manner of a spring barrel of clocks. Although the number of revolutions of a steering wheel is limited to approximately six revolutions, more than six turns should be provided for the FRC 10. The rotary movement of the terminal 8 is therefore not substantially noticeable for an individual turn of the FRC 10. Only the diameter of the wound body comprising all of the turns of the FRC 10 is increased or decreased in size.

Figure 2:
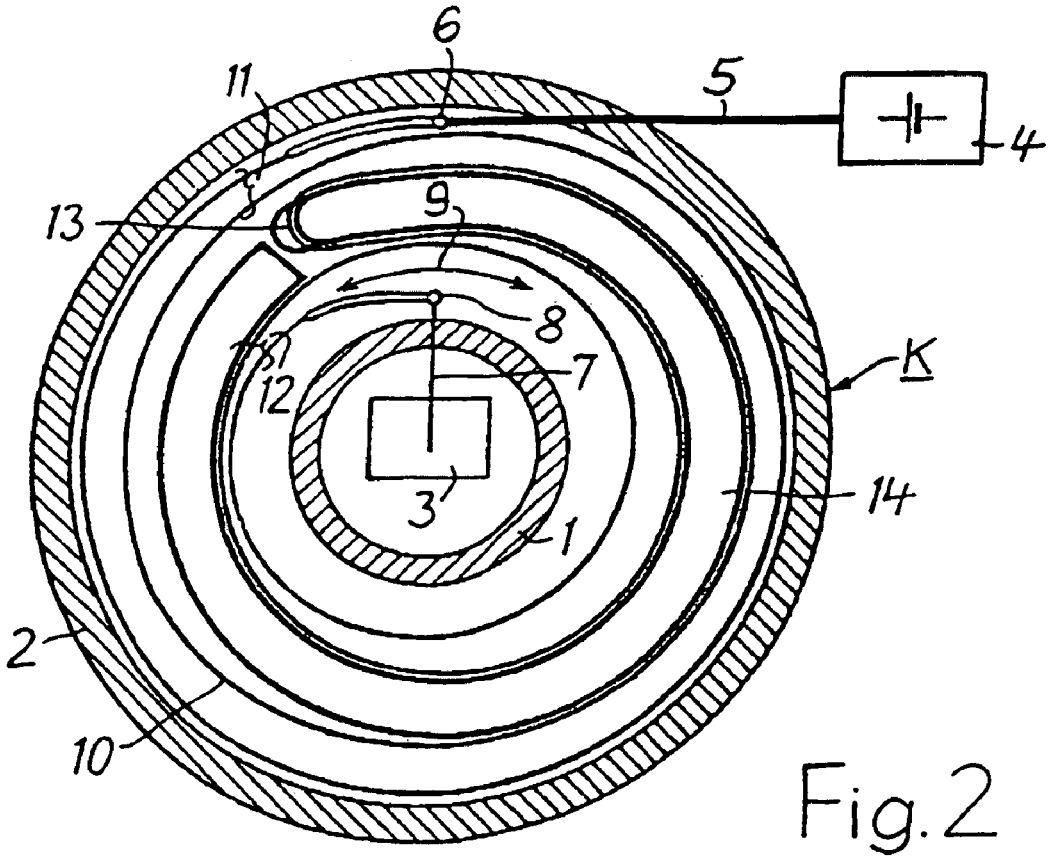
FIG. 2 shows an embodiment of the cassette which has been modified in comparison with FIG. 1.

The FRC 10 can, as shown in FIG. 2, be arranged in the cassette K also in two subwindings, to be precise in an outer winding region 11 and an inner winding region 12. The two winding regions 11 and 12 are identified by brackets. In the central position shown in FIG. 2 and in the installed position of the cassette K, they comprise in each case two to three turns. In the two winding regions 11 and 12, the turns of the FRC 10 have opposite winding senses. The winding regions 11 and 12 are connected to one another by an approximately U-shaped reverse point 13. A guide body 14 is fitted between the two winding regions 11 and 12 and is used for guiding the subwindings of the FRC 10 whilst the rotor of the cassette K rotates.

It should be possible for the apparatus according to the invention to be used with constant dimensions for the cassette K for FRCs with different numbers of conductors and different heights or widths, without an FRC, which is narrower in comparison with the clear height of the accommodating area of the cassette K, being capable of creating noises in the event of vibrations of the cassette K owing to rattling. This applies to any form of a wound body comprising the FRC.

In the embodiment of the cassette K shown in FIG. 3, the FRC 10 is wound, as shown in FIG. 1, in turns in the form of a spring barrel of a clock. It has a shorter height than the accommodating area 15 of the cassette K shown on the right-hand side in FIG. 3, which is circular with a rectangular cross section. In order to compensate for the difference in height between the FRC 10 and the accommodating area 15, an intermediate base 16 is fitted in said accommodating area 15 and is fixed to a cylindrical hub 17 belonging to the rotor R of the cassette K. The intermediate base 16 is arranged at a distance both from a cover face 18, formed by the rotor R, of the accommodating area 15 and from the base 19 of said accommodating area 15 belonging to the stator S. The intermediate base 16 runs parallel to the two, to be precise over the entire radial width of the accommodating area 15, and divides them into a smaller area V for the FRC 10 and an empty area L. The FRC 10 is accommodated virtually without play in the smaller area V between the cover face 18 and the intermediate base 16. The cover face 18 and the intermediate base 16 can also each be provided with a layer 20 consisting of a noise-muffling material.

Figure 7:
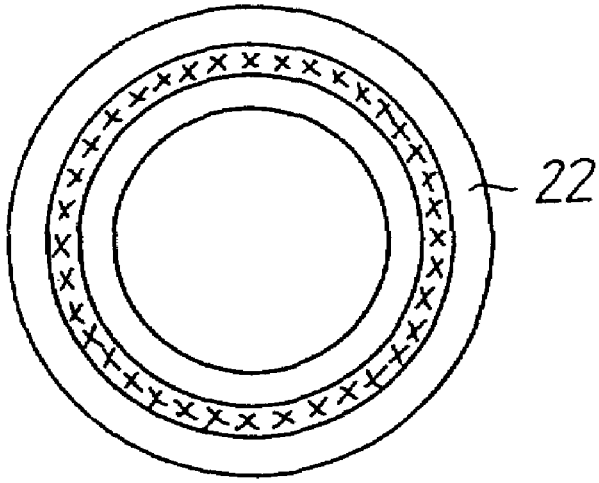

The hub 17 is advantageously split transversely into two parts 21 and 22, which can be joined together without gaps to form the hub 17. In the exemplary embodiment illustrated, the part 22 of the hub 17 has a circumferential, radially outwardly open cutout 23 in the region of its end side, the axial height of said cutout 23 corresponding to the thickness of the intermediate base 16. In the installed position, the intermediate base 16 engages in the cutout 23 and is as a result fixed on the hub 17 if the part 21 is placed on the part 22 thereof. In this case, the cutout 23 forms a bearing surface for the intermediate base 16, which is illustrated in FIG. 7 provided with crosses. Depending on the length of the two parts 21 and 22 of the hub 17, which together always have a length corresponding to the length of the hub 17, the intermediate base 16 can therefore always be fitted at a different height over the base 19 of the cassette K in a simple manner. This height is in each case dimensioned on the basis of the height of the FRC 10. As a deviation from the illustration, the cutout 23 could also be fitted in the part 21 or in each case partially in the two parts 21 and 22 of the hub 17.

The same applies to the cassette K shown in FIGS. 4 and 5, in which the FRC 10 is laid using the reversing technique shown in FIG. 2. In this embodiment of the cassette K, the intermediate base 16 is a limit for the inner winding region 12 of the FRC 10. At the same time, it also has the function of the guide body 14 (FIG. 2) and is fitted, for example, with hollow cylinders 24 as elements of the guide body which protrude into the accommodating area 15 in the direction of the cover face 18. The FRC 10 can be laid around the hollow cylinder 24 in the deflection point 13, as is illustrated in FIG. 5. In this embodiment, the intermediate base 16 therefore does not extend over the entire radial width of the accommodating area 15. In addition, a circumferential gap 26 remains free between the hollow cylinders 24 and the outer wall 25 of the cassette K. The gap 26 is closed at the bottom by projections 27, which protrude inwards, offset from the outer wall 25, in the circumferential direction of the cassette K, without coming into contact with the hollow cylinders 24 or the intermediate base 16. In one preferred embodiment, the projections 27 are in the form of ribs, which are fitted in the corner between the outer wall 25 and the base 19, so as to bear against the two parts. The projections 27 prevent the turns, which bear against the outer wall 25 and therefore against the stator S, of the FRC 10 of the outer winding region 11 from falling down.

The invention claimed is:

1. Apparatus for signal transmission between terminals, between which at least one cable is arranged, which is accommodated in an essentially circular cassette, to which ongoing cables can be connected at the terminals, and whose length is greater than the distance between the terminals, said cassette comprising:

a rotor which can rotate about its axis and bears at least one terminal; and a stationary stator which bears at least one terminal, said rotor and stator delimit a circular accommodating area having a rectangular cross section, which serves the purpose of accommodating the cable, has a cover face and a base, running parallel thereto, and whose clear axial height can be changed in a variable manner by means of at least one intermediate base, wherein the rotor has a cylindrical hub, which runs in the axial direction of the cassette and on which means are provided for fitting the intermediate base, which runs parallel to the cover face and the base of the accommodating area, is arranged at a distance from them, extends at least essentially over the entire radial width of the accommodating area and divides the accommodating area in a variable manner according to the height or width of the cable to be inserted into the cassette into a smaller area for the cable and an empty area.

2. Apparatus according to claim 1, wherein the hub is split transversely into two parts, of which at least one has a radially and outwardly open, circumferential cutout in the region of its end face.

* * * * *